US010080424B2

(12) United States Patent
Findlay

(10) Patent No.: US 10,080,424 B2
(45) Date of Patent: Sep. 25, 2018

(54) CINCH-BASED TOWEL ARREST DEVICE

(71) Applicant: Iain C. Findlay, Phoenix, AZ (US)

(72) Inventor: Iain C. Findlay, Phoenix, AZ (US)

( * ) Notice: Subject to any disclaimer, the term of this patent is extended or adjusted under 35 U.S.C. 154(b) by 20 days.

(21) Appl. No.: 15/341,755

(22) Filed: Nov. 2, 2016

(65) Prior Publication Data

US 2017/0119139 A1 May 4, 2017

Related U.S. Application Data

(60) Provisional application No. 62/249,899, filed on Nov. 2, 2015.

(51) Int. Cl.

| | |
|---|---|
| ***A45F 5/04*** | (2006.01) |
| ***A45F 5/02*** | (2006.01) |
| ***A47L 1/15*** | (2006.01) |
| ***A47L 13/16*** | (2006.01) |
| ***A47L 13/51*** | (2006.01) |

(52) U.S. Cl.

CPC ..... *A45F 5/021* (2013.01); *A47L 1/15* (2013.01); *A47L 13/16* (2013.01); *A47L 13/51* (2013.01); *A45F 5/04* (2013.01)

(58) Field of Classification Search

CPC ..... A45F 5/021; A45F 5/04; A47L 13/51

USPC ..... 248/317; 224/163, 932, 247, 193, 230, 224/195, 585, 584, 904; 206/233

See application file for complete search history.

(56) References Cited

U.S. PATENT DOCUMENTS

D193,678 S * 9/1962 Goldman ..... 224/163
D196,542 S * 10/1963 Zelnick ..... 224/163
3,983,602 A * 10/1976 Barry ..... A42B 3/04 224/181
4,334,643 A * 6/1982 Farmer ..... A01M 31/06 224/153
4,358,036 A * 11/1982 Maltais ..... A45F 5/02 224/163
4,462,507 A * 7/1984 Margulies ..... A47K 10/3818 206/210
4,534,063 A * 8/1985 Krumin ..... G08B 3/1058 224/163
D283,076 S * 3/1986 States, Jr. ..... 224/247
D309,674 S * 8/1990 Gervase ..... 224/247
4,957,232 A * 9/1990 Sprague ..... A45F 5/02 224/249
5,054,672 A * 10/1991 Weissman ..... A45F 5/02 211/89.01
D321,450 S * 11/1991 Goodman ..... D6/546
5,152,443 A * 10/1992 Hagan ..... A41F 9/002 224/148.4

(Continued)

*Primary Examiner* — Michael Safavi

(74) *Attorney, Agent, or Firm* — Thomas W. Galvani, P.C.; Thomas W. Galvani

(57) ABSTRACT

A towel arrest device includes a body and two lips opposed from each other and formed integrally to the body. The lips each have a top, a bottom, and an inflection point therebetween. The lips are parallel, spaced apart, and define a slit between the inflection point and the bottom. The lips further converge toward the slit between the tops and the inflection points. The body biases the lips toward each other in response to expansion of the slit. When an item, such as a towel, is thus introduced into the slit, the slit expands to accommodate the towel but the lips exert an inward bias to cinch the towel and secure it in the device.

16 Claims, 6 Drawing Sheets

(56) References Cited

U.S. PATENT DOCUMENTS 5,232,136 A * 8/1993 Unger ..... A45F 5/02 224/247
5,388,741 A * 2/1995 Hillinger ..... A45F 5/02 206/349
D370,375 S * 6/1996 Murgida ..... D6/526
5,553,345 A * 9/1996 Bell ..... A45F 5/02 15/209.1
5,571,228 A * 11/1996 McMurtrie ..... A01K 97/10 224/247
D387,897 S * 12/1997 Yorke ..... D27/172
5,799,847 A * 9/1998 Sandor ..... A45F 5/02 224/197
D409,031 S * 5/1999 McNaughton ..... D6/546
6,264,079 B1 * 7/2001 Skaggs ..... F41C 33/0236 224/193
6,311,881 B1 * 11/2001 Kamiya ..... A45F 5/02 224/195
7,017,787 B1 * 3/2006 Dean ..... B60R 11/00 2/49.2
7,159,281 B1 * 1/2007 Irizarry ..... A45F 5/021 224/247
7,614,534 B2 * 11/2009 Veo ..... F42B 39/02 224/196
8,056,715 B2 * 11/2011 Conklin ..... B25C 3/002 206/338
8,308,033 B2 * 11/2012 Case ..... A45F 5/02 224/197
8,517,236 B2 * 8/2013 Kushner ..... A45F 5/00 224/247
D702,055 S * 4/2014 Rauch ..... D6/546
9,504,310 B2 * 11/2016 Foreman ..... A45F 5/021
2002/0162866 A1 * 11/2002 Hurtgam ..... F41C 33/0227 224/193
2004/0016784 A1 * 1/2004 Berry ..... A45F 5/00 224/584
2004/0026471 A1 * 2/2004 Gallagher ..... A45F 5/02 224/193
2004/0245303 A1 * 12/2004 Santayana ..... B60R 7/087 224/585
2006/0081494 A1 * 4/2006 Jung ..... A45F 5/021 206/494
2007/0023471 A1 * 2/2007 Garcia ..... A45F 5/02 224/666
2008/0047997 A1 * 2/2008 Mayfield ..... A45F 3/14 224/669
2008/0308665 A1 * 12/2008 Rauch ..... A47K 10/14 242/423
2011/0079690 A1 * 4/2011 Segura ..... A45F 5/02 248/213.2
2014/0124549 A1 * 5/2014 Zarbo ..... A63B 57/00 224/163
2014/0252053 A1 * 9/2014 Rogers ..... F41A 35/00 224/230
2015/0282600 A1 * 10/2015 Richards ..... A45F 5/021 224/195

* cited by examiner

CINCH-BASED TOWEL ARREST DEVICE

CROSS-REFERENCE TO RELATED APPLICATIONS

This application claims the benefit of U.S. Provisional Application No. 62/249,899, filed Nov. 2, 2015, which is hereby incorporated by reference.

FIELD OF THE INVENTION

The present invention relates generally to tools, and more particularly to accessories for holding and carrying cloths and towels.

BACKGROUND OF THE INVENTION

A large number of occupations use a rag, cloth, towel, or similar device (hereinafter, collectively, "towel") to wash, wipe, buff, or otherwise clean something. Window washers, dish washers, car washers, waiters and bus boys, house cleaners, and others will frequently and repeatedly use a towel during the performance of their job. However, they do not need to constantly hold the towel; it is often necessary for their hands to be free of the towel much of the time. Therefore, workers will often use makeshift or sloppy solutions to carry their towels when not using them. Some workers will simply throw the towel over their shoulder. This of course can cause the shoulder of their shirt to become dirty or can allow the towel to drop to the floor where it will pick up additional dirt and debris that will then be passed to the object being cleaned. Others will stuff the towel in their pocket. This, too, leads to dirtying of the clothing and the possibility for a dropped rag. Some might loop the towel through their belt. This is not advantageous because it can be time-consuming to both apply and remove the towel from the belt, and usually requires them to move their eyes from their work to their towel and belt.

As an example, window washers who work low and high on the outside of buildings use a variety of tools in the performance of their jobs. They alternate between using squeegees, scrubbing brushes, poles, towels, buckets, carabiners, and other tools. Often times they store many of these tools in a belt-mounted holster, or in a bucket on the floor next to them. This requires them to access their belt or bucket each time they switch tools. At height, it can be dangerous to repeatedly have to look down to your bucket to find a tool.

Towels, in particular, demand additional concern and attention for several reasons. First, because of their light weight, a worker must position and store a towel carefully to prevent the wind from lifting it away. Thus, the towel must generally be secured, either by stuffing it, fastening it, or weighting it down under something. Second, when a towel is stuffed, fastened, or weighed down, retrieving the towel can pose a hazard to the worker if some deal of upward force is required to lift it. Such force can throw the worker off balance and cause him to fall, creating an especially dangerous situation when the worker is working at height. Third, towels are often dropped stories below, and the worker has to obtain a new one, either by sifting through a bag, or, unpleasantly, descending to pick up the dropped towel or towels. For all of these reasons and more, an improved way to hold a towel is needed.

SUMMARY OF THE INVENTION

A towel arrest device includes a body and two lips opposed from each other and formed integrally to the body.

The lips each have a top, a bottom, and an inflection point therebetween. They are parallel, spaced apart, and define a slit between the inflection point and the bottom. The lips further converge toward the slit between the tops and the inflection points. The body biases the lips toward each other in response to expansion of the slit. When an item, such as a towel, is thus introduced into the slit, the slit expands to accommodate the towel but the lips exert an inward bias to cinch the towel and secure it in the device.

The above provides the reader with a very brief summary of the detailed description presented below, and is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
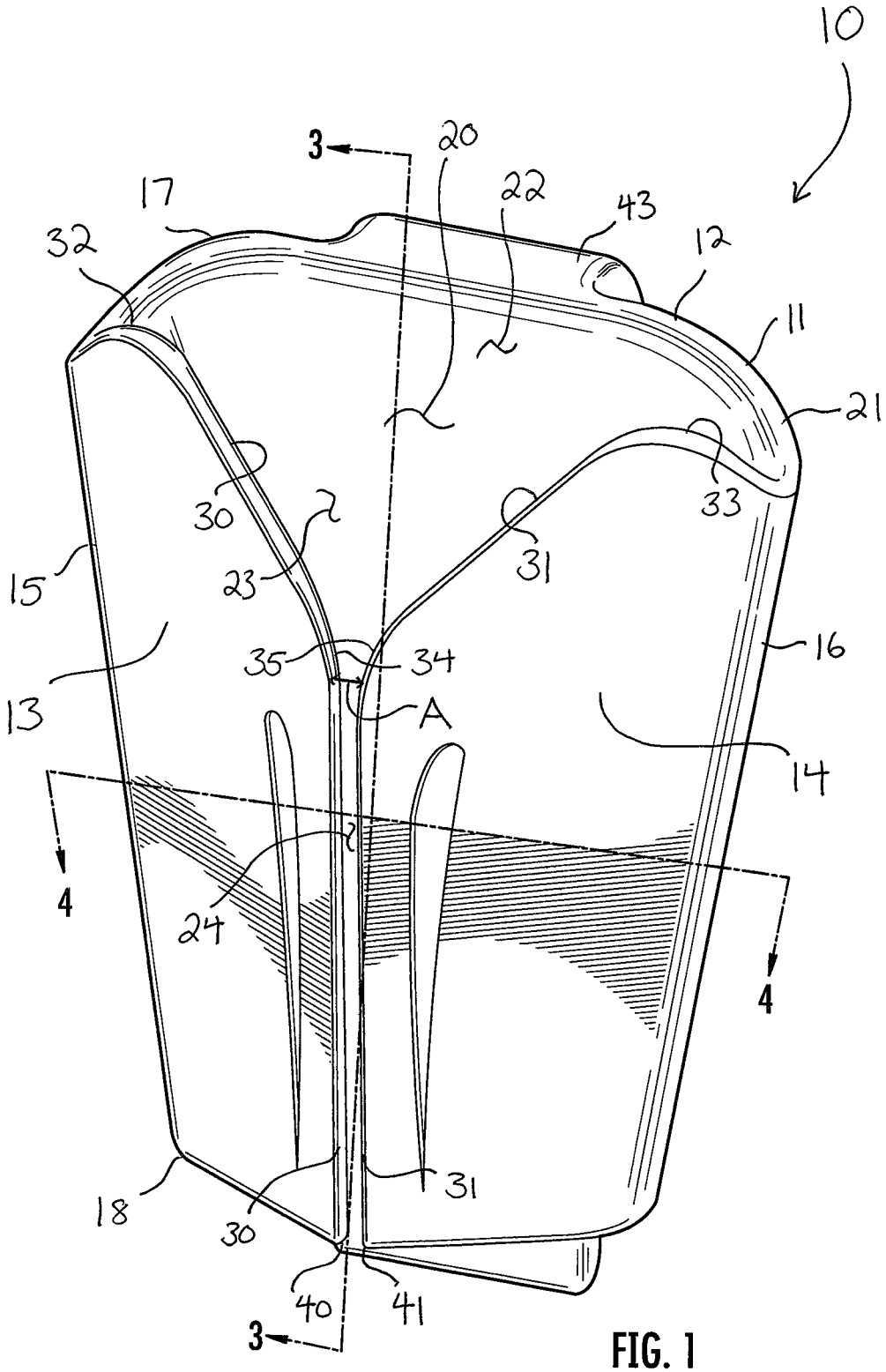
FIGS. 1 and 2 are front and side perspective views, respectively, of a cinch-based towel arrest device.
Figure 2:
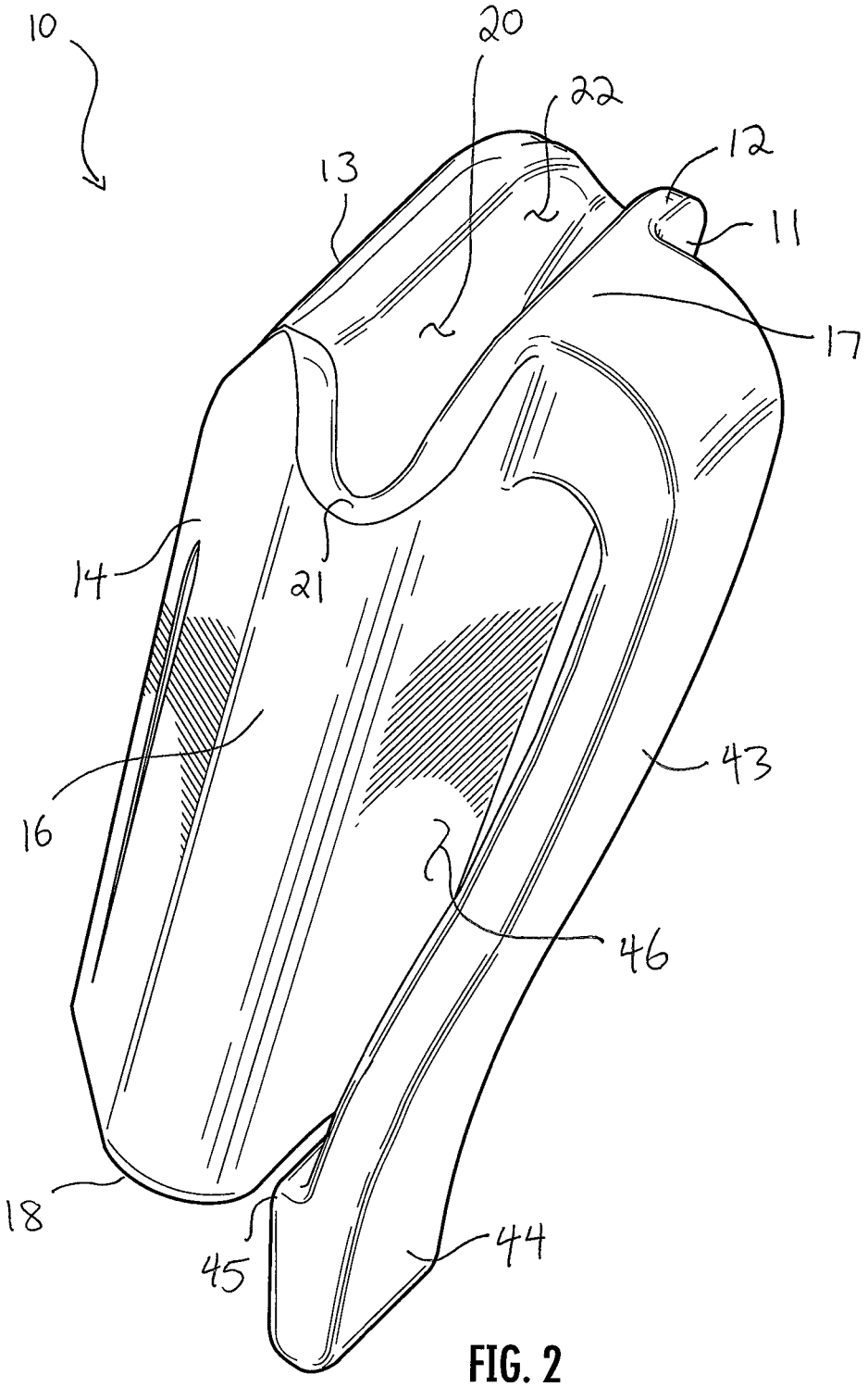

Reference now is made to the drawings, in which the same reference characters are used throughout the different figures to designate the same elements. FIGS. 1 and 2 illustrate a cinch-based towel arrest device 10. The device 10 is useful for safely and conveniently carrying, storing, and retrieving a towel with one hand without the need to watch what the hand is doing, and without posing a danger to the worker using the device 10, as will explained. The device 10 includes a monolithic body 11 having an integral back 12 and an opposed front defined by two opposed wings 13 and 14. The wings 13 and 14 are formed monolithically and integrally to the back 12 at opposed sides 15 and 16, respectively, of the body 11. The sides 15 and 16 are smooth contours that transition from the back 12 into the wings 13 and 14.

The body 11 has a top 17 and an opposed bottom 18. The wings 13 and 14 are large, wide extensions of the back 12 that are generally coextensive to the back 12 between the top 17 and bottom 18. The wings 13 and 14 extend diagonally outward from the sides 15 and 16 forwardly, or outwardly, away from the back 12 between the top 17 and bottom 18. As such, the wings 13 and 14 are disposed in front of and spaced apart from the back 12, thereby defining an interior hold 20 between the wings 13 and 14. The hold 20 is open at both the top 17 and the bottom 18 of the device 10. The hold 20 is uniquely and specially designed and structured to hold towels applied to the device 10, and its size and shape cooperate with the other structural elements and features of the device 10 to securely hold and release towels for the worker.

The device 10 has a single, continuous, contoured edge 21 which extends around the back 12 at the top 17, down the wings 13 and 14, and around the back 12 again at the bottom 18. Proximate to the top 17, the edge 21 defines an inlet or mouth 22 of the device 10 which leads into the hold 20. The mouth 22 is bound by the edge 21 along the top 17 of the back 12 and by the edge 21 along the wings 13 and 14 proximate to the top 17. The mouth 22 is wide and generally oval in shape, projecting from the flat back 12 to the tops of the converging wings 13 and 14. The mouth 22 is an inlet to the hold 20 but also provides and directs access to an entrance 23 to a slit 24 defined between the wings 13 and 14.

The mouth 22 lies primarily in a horizontal plane generally along or just below the top 17 of the device 10. The entrance 23 to the slit 24, in contrast, lies in a diagonal plane that extends forwardly and downwardly from the top 17 of the device 10. Referring to FIG. 1, the entrance 23 has a generally inverted triangular shape. The edge 21 on the wing 13 converges toward the edge 21 on the other wing 14, giving the entrance 23 is triangular shape above the slit 24. The wings 13 and 14 each extend diagonally away from the respective sides 15 and 16, which orient the entrance 23 obliquely with respect to the generally vertical back 12 of the device 10. Thus, the mouth 22 and the entrance 23 cooperate to define an opening that guides towels applied therein toward the slit 24.

The slit 24 is a narrow, generally parallel gap between the wings 13 and 14 to which a towel is applied, and in which the towel is cinched and held when not being used by the worker. The edge 21 along the wings 13 and 14 forms opposed lips 30 and 31, respectively, which extend from high points or peaks 32 and 33, respectively, located at the juncture of the mouth 22 and the entrance 23, to inflection points 34 and 35 to end points 40 and 41 located at the bottom 18. The lips 30 and 31 are straight from the high points 32 and 33 to the inflection points 34 and 35, and are straight again from the inflection points 34 and 35 to the end points 40 and 41. Just outside the peaks 32 and 33, the edge 21 is cupped, or scalloped downward, such that the peaks 32 and 33 transition to valleys and then back up to the top 17 of the body 11 at the back 13. Thus, the peaks 32 and 33 define the top of the lips 30 and 31.

The lips 30 and 31 converge toward each other from the peaks 32 and 33 to the inflection points 34 and 35 and then extend generally parallel to each other from the inflection points 34 and 35 to the end points 40 and 41. At the peaks 32 and 33, the lips 30 and 31 are spaced apart by a distance approximately equal to the width of the mouth 22. However, the lips 30 and 31 converge toward each other, and simultaneously extend outwardly away from the back 12 of the body 11, so that the distance between the lips 30 and 31 decreases. At the inflection points 34 and 35, the lips 30 and 31 are close together, spaced apart by a distance A. Between the inflection points 34 and 35 and the end points 40 and 41, the lips 30 and 31 are consistently spaced apart by this distance A, such that the lips 30 and 31 are generally parallel.

Figure 3:
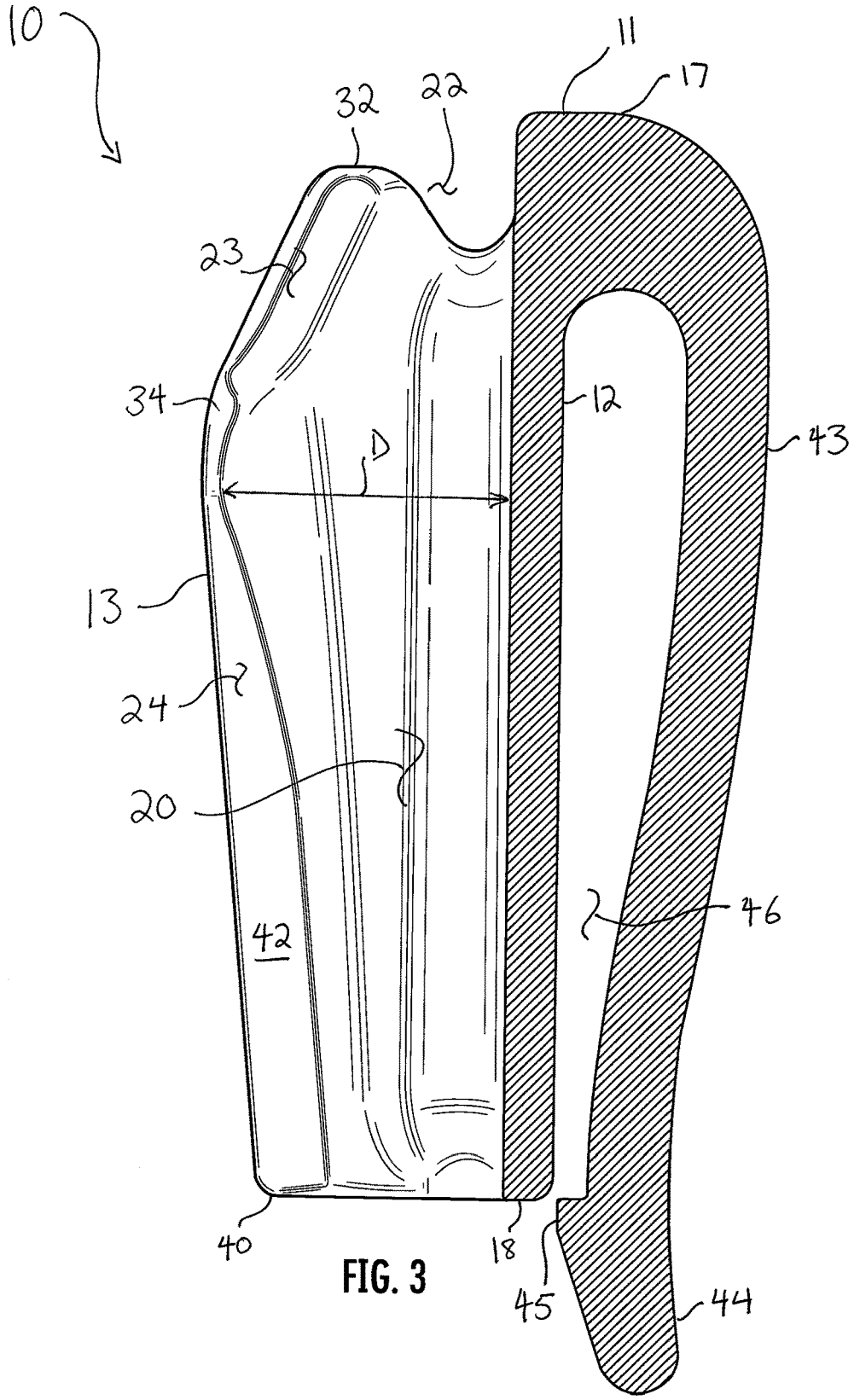
FIG. 3 is a section view of the device of FIG. 1, taken along the line 3-3 in FIG. 1.

The lips 30 and 31 have particular structures which uniquely provide the device 10 with the ability to quickly and easily receive, securely hold, and easily release a towel. Turning to FIG. 3, which is a section view taken along the line 3-3 in FIG. 1 and shows one hemisphere of the device 10, the lip 30 is shown in detail. The lips 30 and 31 are identical but opposite, and one having ordinary skill in the art will readily appreciate that the description herein of the lip 30 applies equally to the lip 31, and for that reason, a description of the lip 31 will not be given.

As can be seen, the lip 30 has an inner face 42. The inner face 42 is flat and directly opposes an opposite flat inner face on the lip 31. The inner face 42 enlarges in width between the inflection point 34 and the end point 40. The inner face 34 is narrow just below the inflection point 34. At the end point, the inner face 42 is widest, and thus presents the largest amount of surface area into the slit 24 between the lips 30 and 31.

Referring to both FIG. 1 and FIG. 3, lip 30 has a particular structure. The lip 30 rotates helically in orientation from the peak 32 to the inflection point 34 to the end point 40; however, as the inner face 42 extends downwardly to the end point 40, the inner face 42 rotates more toward being normal, or perpendicular, to the back 12. From the peak 32 to the inflection point 34, the lip 30 is oriented generally upwardly and outwardly with respect to the back 12. However, at the inflection point 34, the lip 30 turns, and is oriented generally obliquely with respect to the back 12. Then, from the inflection point 34 to the end point 40, the lip 30 is oriented generally inwardly and toward the other lip 31.

Further, as can be seen best in FIG. 3, the lip 30 has an inner face 42. The inner face 42 is flat and opposes an opposite flat inner face on the lip 31. Between the peak 32 and the inflection point 34, the inner face 42 is directed upwardly and inwardly, and also slightly opposite the inner face on the lip 31. This promotes reception of the towel into the hold 20 when a towel is being applied to the device 10. At the inflection point 34, the inner face 42 is oriented generally obliquely with respect to the back 12, such that the flat surface of the inner face 42 is at an angle to the back 12. This creates a first "pinch" on the towel just above the slit 24, in which the converging lips 30 and 31 are directed toward each other sharply and suddenly. Between the inflection point 34 and the end point 40, the inner face 42 is directed nearly directly opposite the inner face 42 on the lip 31, such that the flat surface of the inner face 42 is normal, or perpendicular, to the back 12. The inner face 42 is thus parallel to the opposed inner face on the lip 31. This increases the surface area gripping the towel as the towel is slid through the slit 24, creating a "cinch" in which the lips 30 and 31 are parallel and flat with respect to each other and the towel is caught therebetween. Indeed, as seen in the section view of FIG. 4, the inner face 42 of the lip 30 is directly opposed from, parallel to, and slightly spaced apart from the corresponding inner face of the lip 31. The inner face 42 there can be seen to be nearly perpendicular to the back 12 proximate to the end point 40 of the lip 30.

Figure 4:
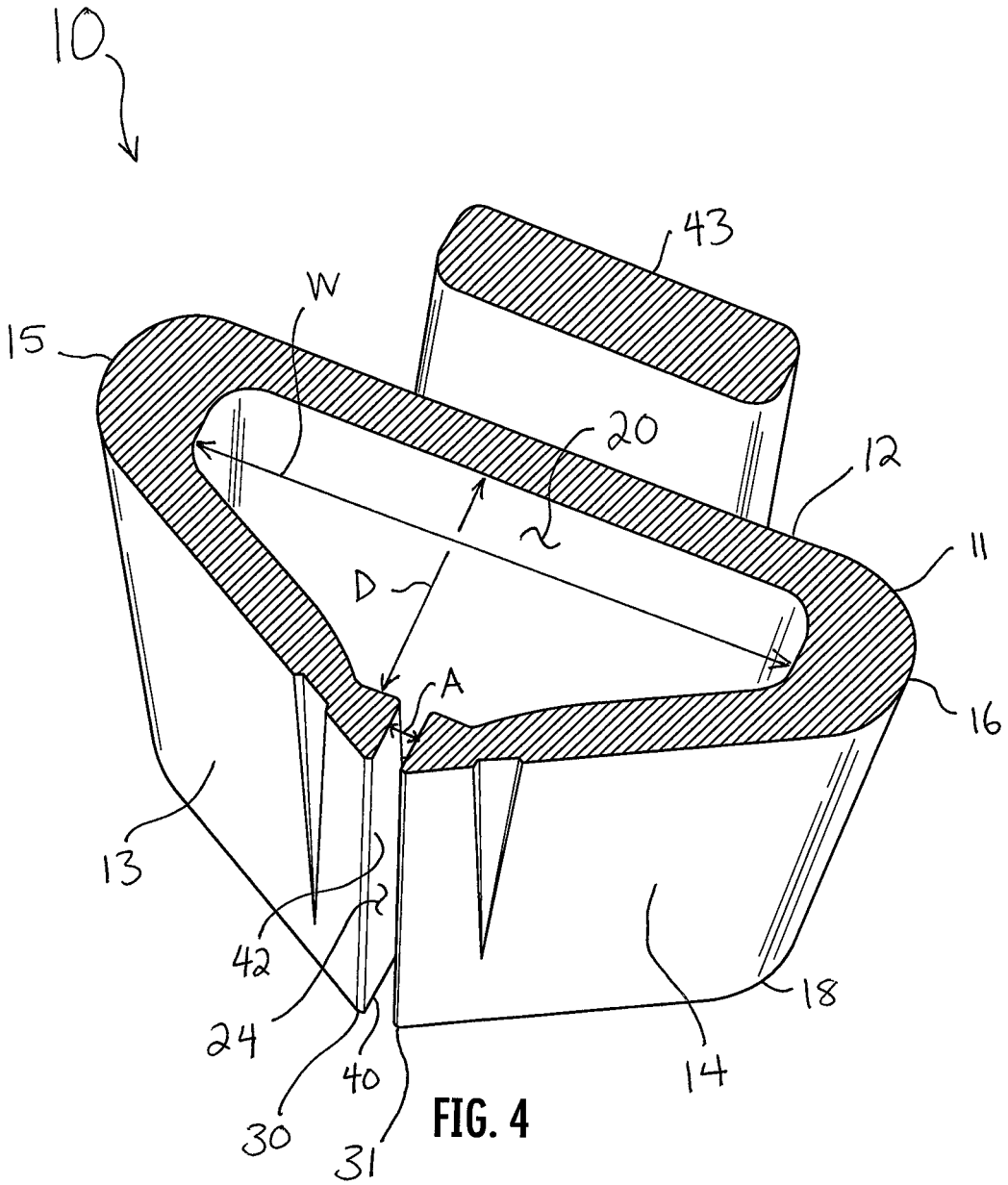
FIG. 4 is a section view of the device of FIG. 1, taken along the line 4-4 in FIG. 1.

In addition to the particular orientation of the inner face 42, the lip 30 has additional unique structure. Referring to FIG. 3, the lip 30 (and likewise, the lip 31) changes in thickness between the peak 32 and the end point 40. Near the peak 32, the lip 30 has a first thickness, which is relatively constant until the inflection point 34, at which the thickness radically decreases. Then, from below the inflection point to the end point, the lip 30 thickens again, such that it is approximately twice as thick between the inflection point 32 and the end point 40 as it is between then peak 32 and the inflection point. This aids in operation: at the inflection point 34, the sudden decrease in thickness aids in the pinch on the towel, and below the inflection point 34, the increased width helps better grip the towel and resist deflection or deformation of the lip 30 by the towel. Turning to FIG. 4, the lip 30 can be seen as a head of the wing 13. The wing 13 has a constant thickness until just before the lip 30, where the thickness decreases. It then increases again to form the lip 30, such that the lip 30 is an enlarged terminus of the wing 13. This reduced thickness just before the lip 30 provides the lip 30 with some flexibility to bend and maintain the inner face 42 directly opposed from the inner face of the lip 31, without compromising the resiliency and strength of the wing 13.

The wings 13 and 14 are formed integrally and monolithically to the back 12 as part of a single piece. The lips 30 and 31 are formed integrally and monolithically to the wings 13 and 14, respectively. As the wings 13 and 14 project in front of the back 12 and are spaced apart from the back 12, so do the lips 30 and 31, and thus the lips 30 and 31 help to define the hold 20. The hold 20 is an interior volume in which portions of an applied towel or towels are contained. The hold 20, having an unusual shape, has unusual dimensions as well. Referring to FIG. 4, the hold has a width W between the sides 15 and 16 and a depth D between the lips 30 and 31 and the back 12. The width W is at a maximum at the mouth 22, and decreases from the top 17 to the bottom 18 of the device 10. Correspondingly, the sides 15 and 16 converge toward each other from the top 17 to the bottom 18. The device 10 is tapered in shape, in other words, from the top 17 to the bottom 18. Further, the depth D increases from the mouth 22 to the inflection points 34 and 35, and then decreases from the inflection points 34 and 35 to the bottom 18. This configuration uniquely provides a large upper opening for towels to be applied into, and a constricting hold for the towels to then be secured in, all in a compact form factor.

The device 10 is constructed from a material or combination of materials having rigidity, resiliency, durability, and shape memory. The wings 13 and 14 are capable of slight flexion toward and away from the back 12. When the wings 13 and 14 flex toward the back 12, they move together and the slit 24 constricts and narrows. When the wings 13 and 14 flex away from the back 12, they move apart and the slit 24 widens and enlarges. When released, the wings 13 and 14 return to their original positions, biased back by the resilient and shape memory characteristics of the body 11 and the wings 13 and 14. When the device is at rest and not in use, or not applied with a towel, the wings 13 and 14 are not stressed or flexed, and the slit 24 is maintained along its entire length, such that the slit 24 is not eliminated and has at least some non-zero dimension, such as a few millimeters. The wings 13 and 14 flex at the sides 15 and 16 so that the back 12 remains rigid and flat. Slight flexion in the wings 13 and 14 improves the performance of the device 10, as will be explained. Further, with the tapered shape of the body 11, the wings 13 and 14 are long and more flexible proximate to the top 17 and shorter and less flexible proximate to the bottom 18; as such, the tapered shape allows more flexibility near the mouth 22 and entrance 23 and less flexibility near the bottom 18. A towel is thus more readily applied into the device 10, and the risk of accidental removal therefrom is mitigated.

Referring primarily to FIGS. 2 and 3, a clip 43 is formed monolithically to the back 12 of the device 12. The clip 43 extends from the top 17 of the device 12 rearwardly away from the back 12. In other embodiments, the clip 43 is releasably fastened to the back 12 with a quick release, bolt, or other fastening assembly. The clip 43 is an arm that extends down to an enlarged head 44 terminating just below the bottom 18. Initially, from the top 17, the clip 43 has a convex curve with respect to the back 12. Proximate to the bottom 18, the clip 43 has a concave curve with respect to the back 12. The head 44 of the clip 43 has an inner barb 45 or ridge directed toward the back 12. The clip 43 and back 12 cooperate to define a receiving space 46 therebetween. Access to the receiving space 46 is primarily through a gap between the head 44 and the bottom 18 at the back 12.

In operation, with the embodiment shown in the various figures, the device 10 is useful for application to a worker's belt while he is working, for simple, one-handed access at any time. One having ordinary skill in the art will appreciate that the device 10 may also suitably be worn on a pocket, a pants waistband, a tool belt, or some other relatively stable, secure mounting location. The need for a stable and secure mounting will be revealed in the remainder of this description, though the description will refer to the device 10 being used on a belt; one having ordinary skill in the art will appreciate how the use will change correspondingly when the device 10 is mounted otherwise.

The device 10 is applied to a belt by placing the head 44 of the clip 43 against one side of the belt and the back 12 of the body 11 against an opposing side of the belt, so as to position the belt at the gap between the head 44 and the bottom 18 at the back 12. The device 10 is oriented with the top 17 directed upwardly and the bottom 18 directed downwardly. The device 10 is pushed down against and over the belt so that the belt biases the head 44 slightly away from the back 12, and the belt moves into the receiving space 46, thereby applying the device 10 to the belt. The device 10 is prevented from accidental removal from the belt by the barb 45, which catches the belt should the device 10 be lifted upwardly accidentally.

Figure 5A:
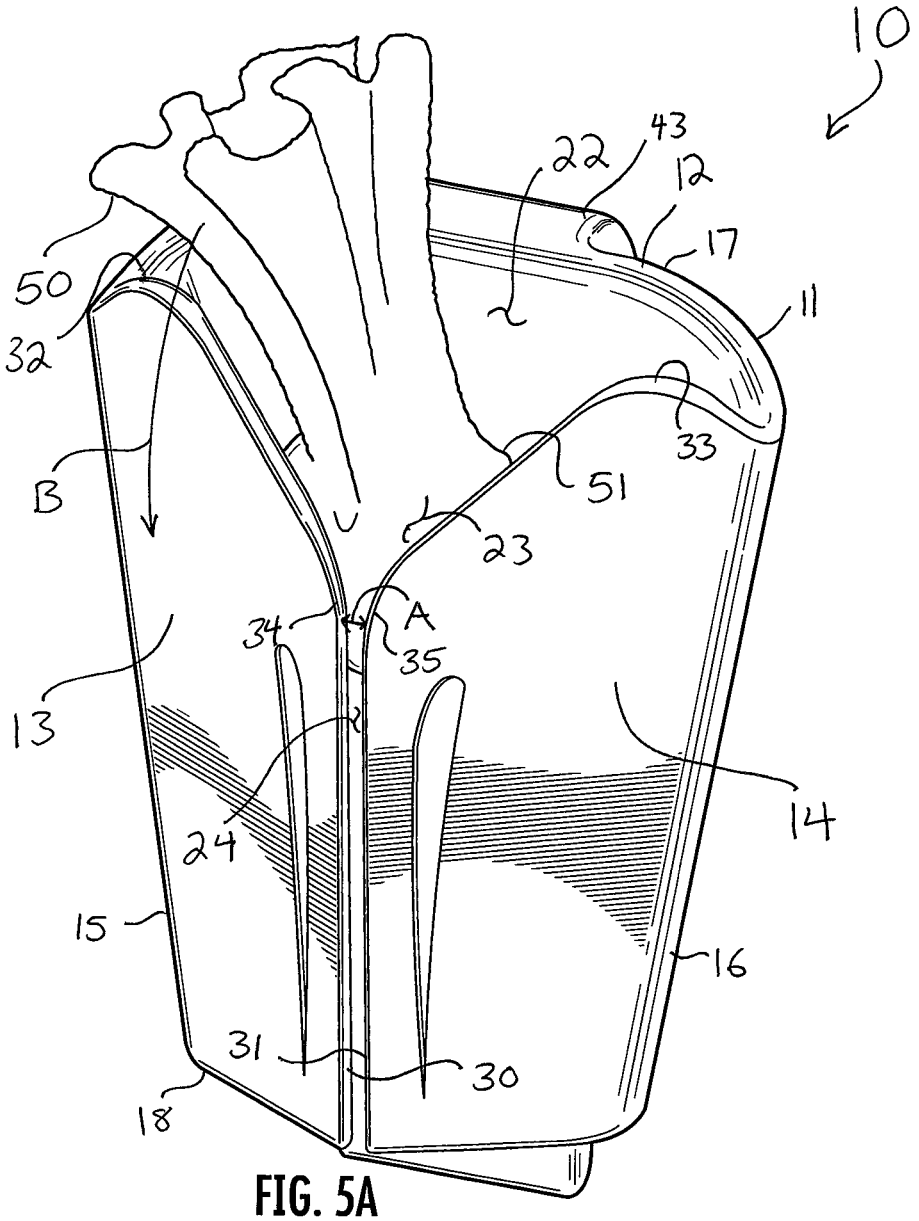
FIGS. 5A and 5B are front perspective views of the device of FIG. 1 with a towel being applied thereto.
Figure 5B:
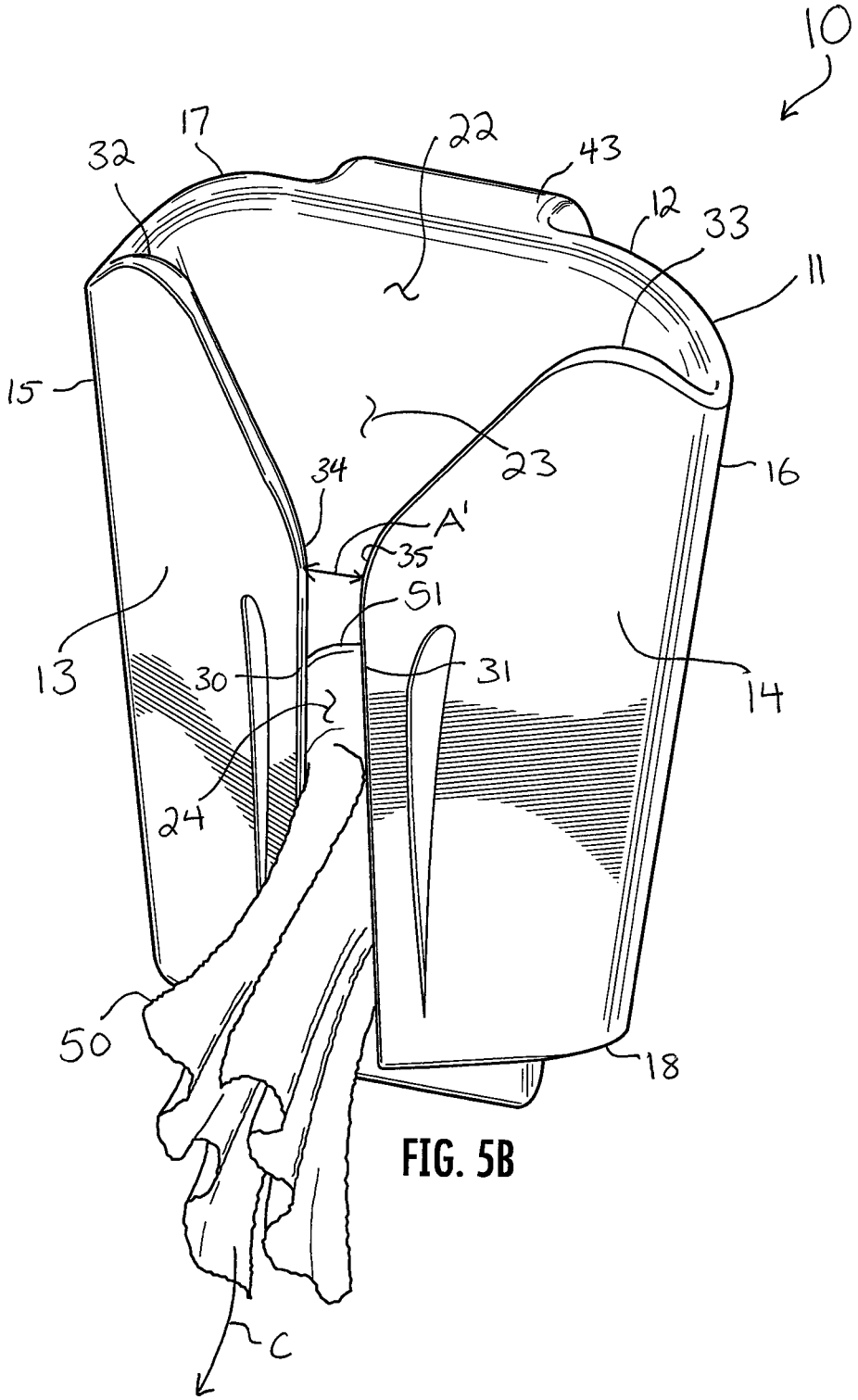

Once thusly secured on the belt, the device 10 is ready for use. The unique, one-handed operation of the device 10, without visual observation or monitoring, is easy, and is described with reference to FIGS. 5A and 5B. The towel 50 is initially at rest in a first position, characterized by the slit having a non-zero dimension and the distance A between the lips 30 and 31. A worker using a towel 50 simply bunches the towel by hand, so that a small bunch 51, pinch, or ball of material is gathered up somewhere along the towel 50. The worker then takes the remainder of the towel 50 in hand, and with the bunch 51 extending out of his hand, applies the bunch 51 to the mouth 22 of the device 10 simply by moving the bunch 51 into the mouth 22. Preferably, the worker has formed the bunch 51 which is just slightly smaller than the mouth 22. With the bunch 51 placed in the mouth 22, the worker merely pulls the remainder of the towel 50 that he holds in his hand down, toward the bottom 18 and along the arrowed line B, and through and into the entrance 23, which guides the towel 50 into the slit 24 between the wings 13 and 14. The wings 13 and 14 flex slightly outward to accommodate the towel 50. The slit 24 is narrow enough such that the towel 50 is bound in the slit 24. The wings 13 and 14 are moved outward by the towel 50, and, in response, provide a compressive bias back on the towel 50, squeezing the towel 50 and holding it in place in the slit 24. The towel 50 is thus secured.

When the towel 50 is received in the slit 24, the device 10 and the lips 30 and 31 are in a second position, slightly different from the first position. The second position is characterized by the slit 24 having a new dimension, designated with the reference character A', which is larger than its original dimension A. In response to the expansion of the slit 24, the monolithic body 11 biased the lips 30 and 31 toward each other. Thus, in this second position, the lips 30 and 31 are biased back toward the first position.

To remove the towel 50, the worker again grabs the remainder of the towel 50 outside the device 10 and pulls down along arrowed line C. By pulling down, rather than up, the towel 50 is brought out of the bottom 18 of the device 10. This is safer than pulling the towel 50 out of the top 17, as this can cause the worker to lose his balance. When a worker pulls the towel 50 out through the top 17, the device 10 moves up with the towel 50, the belt moves up, and the worker must provide more upward force than downward force is necessary to remove the towel 50 from the bottom 18. Further, when the worker pulls the towel 50 up, he performs an awkward lifting motion, which can throw the worker off his balance, creating a dangerous situation, especially when working at height. As such, by pulling the towel 50 down and out through the bottom 18, the worker uses the stability of the device 10 on the belt to his advantage; the device is prevented from moving downward on the belt by the belt, and so the towel 50 must yield by moving out of the slit 24 and free of the device 10. In this way, the worker successfully removes the towel 50 and makes it ready for use.

It is noted that although the foregoing description refers to a single towel 50 being used in the device 10, multiple towels 50 can be used. Multiple towels 50, such as two, three, or four towels 50, may be applied to the device at a time, the towels 50 being applied and removed in a first-in-first-out order.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A towel arrest device comprising:

a body having a back, a top, an opposed bottom, opposed wings integrally formed to the body extending from the back of the body at opposed sides of the body, and a continuous edge extending around the body and forming lips on the wings;

the lips are opposed from each other, extending from the top to the bottom;

the lips are straight from peaks at the top to inflection points between the top and bottom, linearly converge toward each other between the peaks and the inflection points, extend outwardly away from the back between the peaks and the inflection points, are straight from the inflection points to end points at the bottom, and are spaced apart by a thin slit defining a constant gap between the inflection points and the end points;

the edge is cupped at each side, between the peaks of the lips and the back of the body, thereby defining valleys between the peaks and the back;

the lips each have a constant thickness between the peaks and the inflection points, a decreased thickness at the inflection point, and a thickness that enlarges from between the inflection point and the end point;

the lips each have flat inner faces which, between the peaks and the inflection points, are oriented upwardly and inwardly toward the back, and between the inflection points and end points, are oriented toward each other such that the inner faces are parallel and opposed to each other and are normal to the back; and the body biases the lips toward each other in response to expansion of the slit.

2. The towel arrest device of claim 1, wherein the lips are disposed in front of the back, defining a hold between the lips and the back.

3. The towel arrest device of claim 2, wherein the hold has a width and a depth;

the width decreases in dimension from the top to the bottom of the body; and the depth increases in dimension from the top to the inflection points, and decreases in dimension from the inflection points to the bottom of the body.

4. The towel arrest device of claim 1, further comprising:

an entrance to the slit formed between the top of the body and a location generally intermediate to the top and bottom of the body; and the lips converge toward the slit from the entrance.

5. The towel arrest device of claim 4, wherein the entrance is oriented diagonally down and away from the top of the body.

6. The towel arrest device of claim 1, wherein the wings extend linearly and diagonally outward from the sides of the body.

7. A towel arrest device comprising:

a body having a back, a top, an opposed bottom, opposed wings extending from the back of the body at opposed sides of the body, and a continuous edge extending around the body and forming lips on the wings;

the lips opposed from each other and formed integrally to the body;

the lips each have a peak at the top, an end point at the bottom, and an inflection point therebetween, and the lips are straight from peaks to the inflection points between the top and end points, linearly converge toward each other between the peaks and the inflection points, extend outwardly away from the back between the peaks and the inflection points, are straight from the inflection points to the end points, and are spaced apart by a thin slit defining a constant gap between the inflection points and the end points;

the edge is cupped at each side, between the peaks of the lips and the back of the body, thereby defining valleys between the peaks and the back;

the lips each have a constant thickness between the peaks and the inflection points, a decreased thickness at the inflection point, and a thickness that enlarges from between the inflection point and the end point;

the lips each have flat inner faces which, between the peaks and the inflection points, are oriented upwardly and inwardly toward the back, and between the inflection points and end points, are oriented toward each other such that the inner faces are parallel and opposed to each other and are normal to the back; and the body biases the lips toward each other in response to expansion of the slit.

8. The towel arrest device of claim 7, wherein the lips are disposed in front of the body, defining a hold between the lips and the back of the body.

9. The towel arrest device of claim 7, further comprising:

the wings are integrally formed to the back of the body; and the wings extend diagonally outward from the back of the body at the sides of the body.

10. The towel arrest device of claim 7, wherein the body is tapered from the top of the body to the bottom of the body.

11. A towel arrest device comprising:

a body having a top, an opposed bottom a back, opposed wings integrally formed to the body extending from the back of the body at opposed sides of the body, and a continuous edge extending around the body and forming lips on the wings;

the lips are opposed, spaced-apart first and second lips defining an elongate thin slit therebetween;

the first and second lips are straight from peaks at the top to inflection points between the top and bottom, linearly converge toward each other between the peaks and the inflection points, extend outwardly away from the back between the peaks and the inflection points, are straight from the inflection points to end points at the bottom, and are spaced apart by said thin slit defining a constant gap between the inflection points and the end points;

the edge is cupped at each side, between the peaks of the first and second lips and the back of the body, thereby defining valleys between the peaks and the back;

the first and second lips each have a constant thickness between the peaks and the inflection points, a decreased thickness at the inflection point, and a thickness that enlarges from between the inflection point and the end point the first and second lips each have flat inner faces which, between the peaks and the inflection points, are oriented upwardly and inwardly toward the back, and between the inflection points and end points, are oriented toward each other such that the inner faces are parallel and opposed to each other and are normal to the back;

the first and second lips are moveable with respect to each other between a first position, in which the slit has a non-zero first dimension, and a second position, in which the slit has a second dimension larger than the first dimension; and in the second position, the first and second lips are biased toward the first position;

wherein introduction of an item into the slit moves the first and second lips out of the first position into the second position.

12. The towel arrest device of claim 11, wherein the first and second lips are disposed in front of the body, defining a hold between the lips and the body.

13. The towel arrest device of claim 12, wherein the hold has a width and a depth;

the width decreases in dimension from the top to the bottom of the body; and the depth increases in dimension from the top to the inflection points, and decreases in dimension from the inflection points to the bottom of the body.

14. The towel arrest device of claim 11, further comprising:

an entrance to the slit formed between the top of the body and a location generally intermediate to the top and bottom of the body; and the lips converge toward the slit from the entrance.

15. The towel arrest device of claim 14, wherein the entrance is oriented diagonally down and away from the top of the body.

16. The towel arrest device of claim 11, wherein the wings extend linearly and diagonally outward from the sides of the body.

* * * * *